United States Patent [19]

Nazar

[11] Patent Number: 4,650,245

[45] **Date of Patent: * Mar. 17, 1987**

[54] PORTABLE UPRIGHT CHAIR WITH INSULATED SEAT COOLER

[76] Inventor: Robert C. Nazar, 3730 Longview Dr., Carlsbad, Calif. 92008

[ * ] Notice: The portion of the term of this patent subsequent to Oct. 2, 2001 has been disclaimed.

[21] Appl. No.: 783,350

[22] Filed: Oct. 2, 1985

[51] Int. Cl.[4] ..... A47C 7/62

[52] U.S. Cl. ..... 297/192; 297/188

[58] Field of Search ..... 297/192, 377, 27, 378, 297/372, 191, 193, 188

[56] References Cited

U.S. PATENT DOCUMENTS

| | | | |
|---|---|---|---|
| 2,264,744 | 12/1941 | Dunnam | 312/235 R |
| 2,982,455 | 5/1961 | Rosen | 297/192 X |
| 3,295,886 | 1/1967 | Goldmerstein | 297/180 |
| 3,560,047 | 2/1971 | Davis | 297/192 X |
| 3,659,898 | 5/1972 | Yellin | 297/27 X |
| 4,061,395 | 12/1977 | Boole | 297/192 |
| 4,213,649 | 7/1980 | Sell | 297/188 X |
| 4,474,407 | 10/1984 | Nazar | 297/377 X |
| 4,527,830 | 7/1985 | Meyers | 297/192 |
| 4,556,250 | 12/1985 | Chapman et al. | 297/275 X |

*Primary Examiner*—Peter A. Aschenbrenner
*Assistant Examiner*—José V. Chen
*Attorney, Agent, or Firm*—Baker, Maxham & Jester

[57] ABSTRACT

A folding chair includes a hollow box like housing forming a seat support structure and is insulated to form a cooler compartment having a front access opening for providing access to the compartment for a person seated on the seat support, a backrest is pivotally secured to the housing for extending upward in a support position and foldable onto the seat platform for a collapsed position with a pair of U-shaped leg members pivotally secured to the housing for supporting the housing in an elevated position with the legs connected by linkage means to the backrest and foldable therewith to the collapsed position.

16 Claims, 4 Drawing Figures

PORTABLE UPRIGHT CHAIR WITH INSULATED SEAT COOLER

BACKGROUND OF THE INVENTION

1. Field of the Invention

This invention relates to portable chairs of the picnic or beach variety which may be provided with an accessed, thermally insulated seat compartment for both carrying and insulating perishable foodstuffs, canned or bottled beverages, ice, or the like.

2. Prior Art

Known folding chairs constructed of tubular aluminum with nylon or canvas covering material or the like are well known. These portable chairs have the virtue of being very light to carry and provide an inexpensive means for comfortable reclining. Many conventional chairs require the occupant to sit near the ground and are sometimes provided with short legs. Some of these chairs include a seat portion and a back portion which is positioned directly on the sand or ground.

To spend the day at the beach, conventional practice involves using and carrying a comfortable chair, a portable cooler for beverages and lunches, and a container to hold towels and other small articles. This conventional practice is relatively expensive and cumbersome to carry. Known folding chairs have the disadvantage of not possessing any storage facilities which can hold small articles and thermally insulate perishable foodstuffs or bottled beverages.

A number of alternative means have been proposed to overcome some of the difficulties with conventional chairs. For example, several chairs have been devised with storage capability for beach or camping. Siday U.S. Pat. No. 1,900,847 discloses a chair with a receptacle in the seat. Taipalus, U.S. Pat. No. 4,210,363 discloses a seat with insulation in a receptacle area. Similarly, McDole, U.S. Pat. No. 2,357,214 discloses a fishing tackle box and receptacle with seat platform.

A variety of tackle box chairs and beach chairs exist and while each serves a specific purpose, the alternative means provided require insulating and carrying means, and are sometimes difficult to access without standing. Many of the alternatives available suffer from tipping or require the occupant to sit very low to the ground, and some are quite cumbersome to carry.

SUMMARY OF THE INVENTION

It is an object of this present invention to provide an adjustable foldable chair of the type mentioned which overcomes at least some of the aforementioned disadvantages and concurrently therewith provides a thermally insulated storage facility for securing and storing canned or bottled beverages, ice, perishible foodstuffs, fishing bait, or other small articles.

It will be seen that the present invention overcomes some of these inadequacies by providing an easily grasped closure panel or lid to a seat platform with a thermally insulated compartment supported a comfortable distance from the ground by leg members.

A further object is to provide a comfortable chair having easy access to the above mentioned compartment, cushioning and contoured seat portion, armrest support, and a padded shoulder strap for comfortable carrying.

Another object is to provide a new and improved device which folds compactly and securely for storage and transport.

A further object is to provide a new and improved device which is lightweight, durable, easily maintained, and low in cost.

These together with other objects and advantages which will become apparent reside in the details of construction and operation as will be more fully described and claimed, references being made to the accompanying drawings forming a part hereof, wherein like numerals refer to like parts throughout and in which:

BRIEF DESCRIPTION OF THE DRAWINGS

The invention will hereafter be elucidated with reference to the drawings.

DETAILED DESCRIPTION OF THE INVENTION

Figure 1:
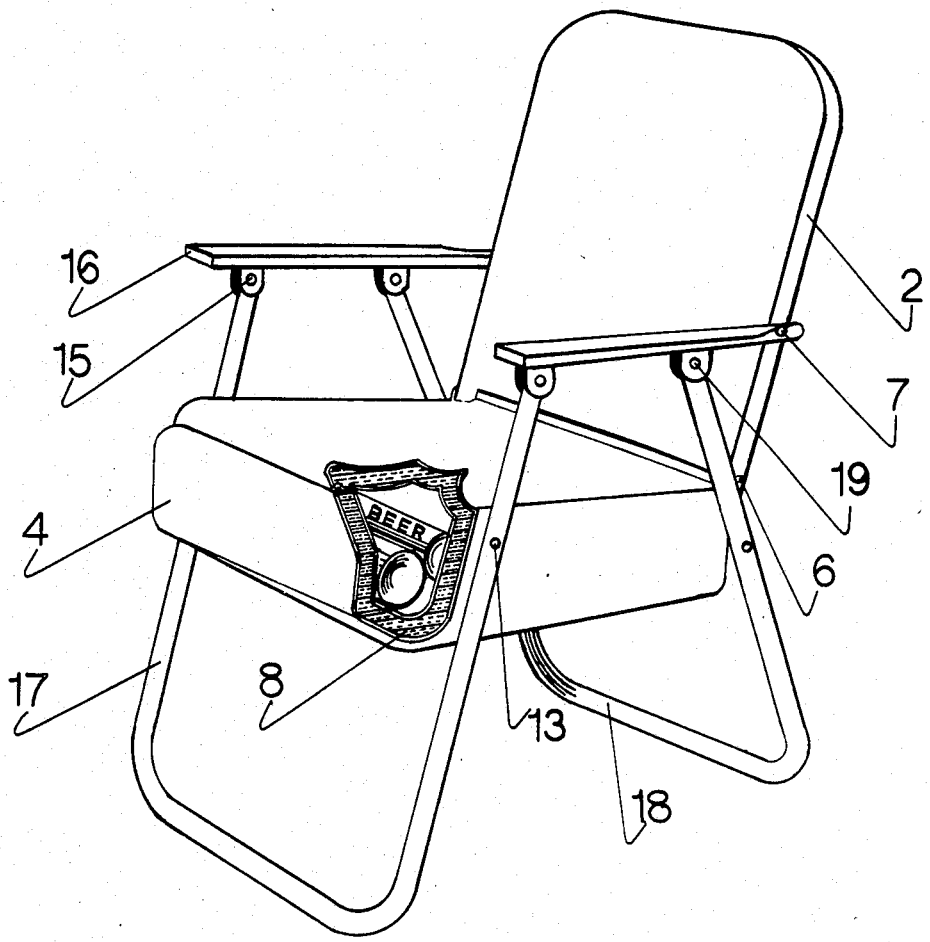
FIG. 1, is a perspective view of my invention in use with a cut away front view.
Figure 4:
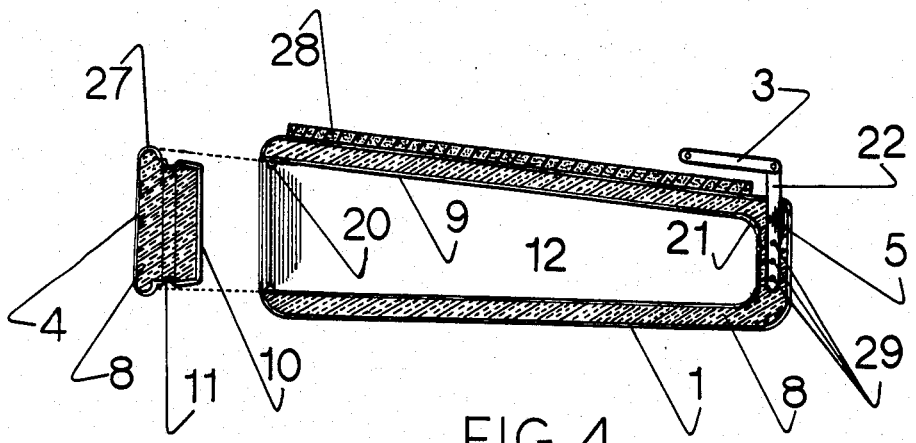
FIG. 4, is a cross sectional side view of the seat and lid portion of my invention.

Turning now to the drawings, with particular emphasis to FIGS. 4 and 1, it will be seen that the chair of this invention includes a hollow box like housing having an upper generally rectangular wall defining a seat platform 1 of injection moulded plastic, nylon, or other suitable material, which is defined by front, back and side walls and an open front compartment, and lower generally rectangular wall.

An insulated closure panel of similar materials can be securely engaged to the seat platform to seal and insulate the seat compartment. The insulated closure panel or lid 4 may be engaged with liner 9 of plastic or similar materials at liner protrusion 20 and at lid recess contour 11. Said lid 4 is preferably contour moulded 27, so as to be easily grasped when engaging and disengaging. The inner portion of the lid 4 is preferably provided with insulating material 8 of polyurethane foam or similar insulating material and is protected with a lining material 10 of plastic, thermoplastic, or other suitable material.

Figure 3:
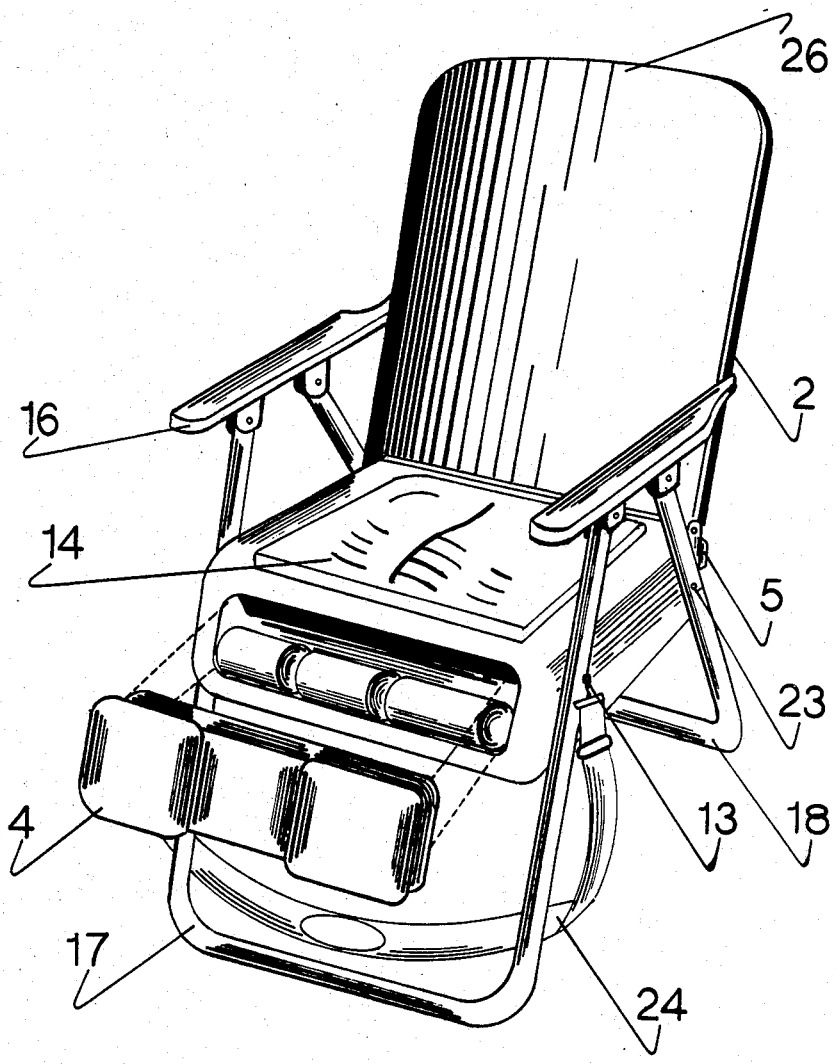
FIG. 3, is a perspective view of my invention in use with an exploded view of lid.

The top portion of the seat platform 14 may be anatomically moulded as shown in FIG. 3 to the contour of the buttocks to provided added comfort to the occupant of the chair, this top portion 14 is preferably covered with a cushioning material of soft polyethylene foam or other suitable material 28 as shown in FIG. 4. Thermal insulating material 8 of polyurethane foam or similar insulating material, is preferably placed on the inside bottom, rear, and sides of the hollow seat compartment 12 and directly beneath and inside the top portion of the seat 14. A protective and stiffening liner 9 of plastic, thermoplastic, or similar materials, is preferably placed adjacent to the insulation 8 areas to protect the items contained in storage and to define the hollow inner compartment. This liner 9 is ideally provided with contour 21 to prevent debris from collecting and to allow easy cleaning. The entire hollow seat portion may be inexpensively moulded in one piece and foamed in place so as to be lightweight, inexpensively made, and easily reinforced to prevent collapse when occupied.

Figure 2:
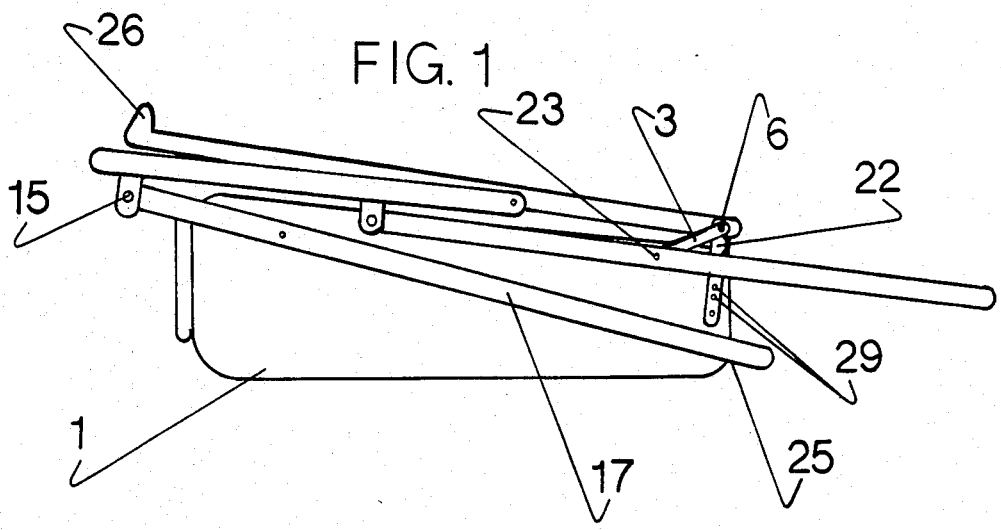
FIG. 2, is a detailed side view showing my invention as folded.

A link member 22 of metal or other suitable material is securely fastened to seat portion 1 at 29 by rivets, screws, or the like as shown in FIG. 4. This linkage plate 22 has an integrated checkplate or protrusion 5 as shown in FIG. 3. A support strut or link member 3, of wood, metal, plastic, or other suitable material is pivotally connected at 6 by similar means to link member 22 whereby the link member 3 is pivotally free to extend forward and back for folding and securely engages checkplate or protrusions 5 when fully opened for use. Link member 3 is pivotally secured by rivets, screws, or the like to rear leg member 18 at 23 as shown in FIG. 2.

A U-shaped backrest member 2 of tubular aluminum construction, plastic, or other suitable material is pivotally secured by rivets or similar means as shown at 6 to link member 22. A U-shaped rear leg member 18 of tubular aluminum construction, plastic, or other suitable material is pivotally secured by similar means to link member 3 at 23 and to armrest member 16 at 19. A U-shaped front leg member 17 of similar materials is pivotally secured by similar means to seat portion 1 at 13 and to armrest member 16 at 15. Backrest member 2 is preferably contoured or bowed as seen at 26 to provide greater comfort to the occupant of the chair. Said chair is preferably provided with armrests 16 of wood, metal, plastic, or the like, secured to backrest member 2 by similar means at 7.

Front leg member 17 is preferably constructed of a length allowing it to securely and tightly engage the back edge or rear side wall of the seat structure 1 at 25 when folded for carrying. The purpose of this tight fit being to prevent the chair from opening when carried. Additionally, an adjustable shoulder strap 24 may be secured by clips, rivets, or similar materials as shown a 13 in FIG. 3. The purpose of the shoulder strap being to provide a more comfortable means of carrying, to prevent parts opening when carried, and to assure the distribution of weight of the contents to the rear of the compartment 12 and away from the lid 4.

From the above description and drawings it will be apparent that I have disclosed a chair and container combination comprising a hollow box-like housing having an upper generally rectangular wall defining a seat platform and a lower generally rectangular wall defining a generally horizontal base surface, said upper and lower walls being joined by a common back edge and generally triangular side walls defining a seat structure and an open front compartment, said upper and lower said side walls being constructedd of insulating material for thermally insulating said open front compartment, and an insulated closure panel for covering said open front and for providing access to said compartment for a person in a seated position on said seat support platform and a back rest pivotally secured to said housing.

Having illustrated and described a preferred embodiment as well as variants of this invention, it will be obvious to those skilled in the art that further changes and modifications may become apparent. Such changes and modifications are not to affect this instant concept and are to be considered within the scope and essence of this invention.

Having thus described this invention what is claimed as new is:

1. The combination of a portable insulated container and folding chair, comprising:

a hollow box like housing having an upper generally rectangular wall defining a seat support platform and a lower generally rectangular wall defining a generally horizontal bottom surface, said upper and lower walls joined by back, and side walls defining a seat structure and an open front compartment, said upper, lower, and back side walls constructed of insulating material for thermally insulating said open front compartment, and an insulated closure panel for covering said open front and for providing access to said compartment for a person in a seated position on said seat support platform, and a back rest pivotally secured to said housing for extending upward in a support position and foldable onto said seat platform, and a pair of generally U-shaped leg members pivotally secured to said housing for supporting said housing in an elevated position, said legs connected by linkage means to said backrest and foldable therewith to a compact collapsed position.

2. The combination of claim 1 comprising:

an elongated carrying shoulder strap having ends, and connected at said ends to said housing at the connection of said front leg member thereto for carrying said housing with said open front oriented upwardly.

3. The combination of claim 1 comprising:

said front leg member is securely engaged to back side wall when in the fully folded position.

4. The combination of claim 1 wherein:

said leg members define a front leg member and a back leg member, said front leg member pivotally connected directly to the side walls of said housing, and said back leg member connected by a pair of link members to said side walls.

5. The combination of claim 2 comprising:

a pair of arm rests defining said linkage means and pivotally connecting the ends of said leg members to one another and to said backrest.

6. The combination of claim 1 wherein:

said housing is of a unitary construction and said closure panel is of a snap-fit construction.

7. The combination of claim 1 wherein:

said housing is constructed of a unitary construction of molded plastic defining the outer surface of said walls with an insulating lining adjacent said wall and an internal lining of plastic forming the inside surface of said walls defining said compartment.

8. The combination of claim 7 wherein:

said upper wall is moulded to the contour of the buttocks of an occupant to enhance the comfort of the occupant of the chair.

9. The combination of claim 8 including:

a cushion secured to and covering said upper wall.

10. The combination of claim 9 wherein:

said leg members define a front leg member and a back leg member, said front leg member is pivotally connected directly to the side walls of said housing, and said back leg member is connected by a pair of link members to said side walls.

11. The combination of claim 10 wherein:

a pair of arm rests defining said linkage means and pivotally connecting the ends of said leg members to one another and to said backrest.

12. The combination of claim 11 including:

an arm secured to each side of said housing at the back side walls and extending upward above the upper surface of said housing for connecting said pair of link members to said side walls.

13. The combination of claim 12 wherein:

said pair of links are in compression when supporting said housing.

14. The combination of claim 13 wherein:

said closure is of a snap-in construction.

15. The combination of claim 1 wherein:

said closure is of a snap-in construction.

16. The combination of claim 15 comprising:

an elongated carrying shoulder strap having ends connected at the point of connection of said front leg member to said point of connection of said front leg member to said housing for carrying said housing with said open front oriented upwardly.

* * * * *